United States Patent [19]

Suddarth

[11] 4,068,413

[45] Jan. 17, 1978

[54] ADJUSTABLE LENS GRINDING APPARATUS

[76] Inventor: Jack M. Suddarth, 5551 18th, St. Petersburg, Fla. 33710

[21] Appl. No.: 619,041

[22] Filed: Oct. 2, 1975

[51] Int. Cl.[2] ..... B24B 9/14; B24B 17/02

[52] U.S. Cl. ..... 51/55; 51/124 L; 51/127

[58] Field of Search ..... 51/33 R, 55, 124 L, 51/126, 127, 284

[56] References Cited

U.S. PATENT DOCUMENTS

| | | | |
|---|---|---|---|
| 2,747,339 | 5/1956 | Schelling | 51/124 L |
| 2,757,487 | 8/1956 | Coburn | 51/55 X |
| 2,806,327 | 9/1957 | Coburn | 51/55 X |
| 3,458,956 | 8/1969 | Suddarth et al. | 51/33 R |
| 3,835,588 | 9/1974 | Whitham | 51/58 |

*Primary Examiner*—Al Lawrence Smith
*Assistant Examiner*—James G. Smith
*Attorney, Agent, or Firm*—Duckworth, Hobby & Allen

[57] ABSTRACT

An adjustable lens grinding apparatus of the type having a chuck for securing a planar lens blank thereto, an abrading cup for sweeping through the lens blank during an abrading stroke, and further including an improvement in the apparatus for positioning the chuck with respect to the abrading cup and guiding the abrading cup during the abrading stroke. The improvement includes a first member for supporting the chuck and a second member for supporting the abrading cup spaced longitudinally from said chuck. The abrading cup includes an axis of rotation centered therethrough and an annular abrading surface at the distended circumference thereof. A positioning apparatus is coupled between the first and second members for regulating the relative motion therebetween in two degrees of linear freedom and one degree of rotational freedom, with the two degrees of linear freedom defining a base plane perpendicular to the plane of the lens blank and the one degree of rotational freedom defining a first axis parallel to the plane of the lens blank. The improvement further includes a guide having a cambered surface therein and an apparatus for following the guide. The guide and the guide following apparatus are interposed between the first and the second members for guiding the sweep of the abrading cup through the lens blank during the abrading stroke. The improvement also includes an apparatus for altering the camber of the guide, whereby the sweep of the abrading cup through the lens blank during the abrading stroke may be altered to provide a plurality of different lens surfaces.

30 Claims, 11 Drawing Figures

ADJUSTABLE LENS GRINDING APPARATUS

BACKGROUND OF THE INVENTION

This invention relates to the art of grinding optical lenses, and particularly to an apparatus for generating compound surfaces on ophthalmic lens blanks.

DESCRIPTION OF THE PRIOR ART

Lens generators are well known in the art. A typical lens grinding device utilizes a cup-shaped cutting tool mounted on a tool holding assembly, a tailstock to which a chuck is mounted for holding the work, a pivoted coupling between the tool holding assembly and the base, and a means for adjusting the position of the tool and the position of the tailstock. In operation the tool holding assembly moves the abrading tool about a pivot and grinds a lens blank fixed in the tailstock chuck. After each sweep of the lens grinding tool a new lens blank may be coupled to the work holding chuck for the next grinding operation. This type of lens grinding apparatus is described by Coburn in U.S. Pat. Nos. 2,757,487 and 2,806,327 and by Phillips in U.S. Pat. No. 2,975,565. A similar lens grinding apparatus for contact lenses is described by Witham in U.S. Pat. No. 3,835,588.

The construction and operation of a basic lens grinding machine is well illustrated by U.S. Pat. No. 3,289,355 issued jointly to the present inventor and others. The present inventor has also obtained subsequent patents which disclose further improvements to the basic lens grinding machine: U.S. Pat. Nos. 3,449,865 and 3,458,956. The three aforementioned patents issued to the present inventor are hereby incorporated by reference as examples of the existing lens grinding apparatus to which the improvements disclosed herein are to be applied. This listing is not to be considered exclusive. Other patents describing lens generators may be found in U.S. Patent classes 51-33 and 51-55, among others.

The present state of the art requires that either the lens or the abrading cup be swept across the plane of the lens blank to form a curved surface thereon. The radius of this curved surface is formed from a central pivot point which is relatively fixed with respect to the plane of the lens blank. This technique precludes the selection of extremely long sweep radii (approaching infinity) without elongating the sweeping member to unreasonable lengths. Also, this technique precludes the generating of lenses of extremely long radii or combining long radii of both concave and convex curvatures on a lens surface which in the optical trade is called a "saddleback" curve. Prior to this disclosure, this type of lens had to be ground by hand and is most time consuming. With the ability of changing the angle of the work head motor to any degree to abrade in a concave or convex manner, it is possible to create any type of cross curve or vertical curve without regards to the angle of the guiding cam.

SUMMARY OF THE INVENTION

A lens grinding apparatus of the type having a chuck for securing a planar lens blank thereto and an abrading cup for sweeping through a lens blank during an abrading stroke. An improvement is herein disclosed for an apparatus for positioning the chuck with respect to the abrading cup and guiding the abrading cup during the abrading stroke. This improvement apparatus includes a first member for supporting the chuck and a second member for supporting the abrading cup, with the abrading cup having an axis of rotation centered therethrough and an annular abrading surface at the distended circumference thereof. A positioning means is coupled between the first and second members for regulating the relative motion therebetween in two degrees of linear freedom and one degree of rotational freedom, the two degrees of linear freedom defining a base plane perpendicular to the plane of the lens blank, with the one degree of rotational freedom defining a first axis parallel to the plane of the lens blank. The improvement apparatus further includes a guide having a cambered surface thereon and means for following the guide, with the guide and the guide following means being interposed between the first and second members for guiding the sweep of said abrading cup through the lens blank during the abrading stroke. The improvement apparatus further includes a first means for altering the camber of the guide, whereby the sweep of the abrading cup through the lens blank may be altered to provide a plurality of different lens surfaces.

DETAILED DESCRIPTION OF THE PREFERRED EMBODIMENT

Figures 1, 2:
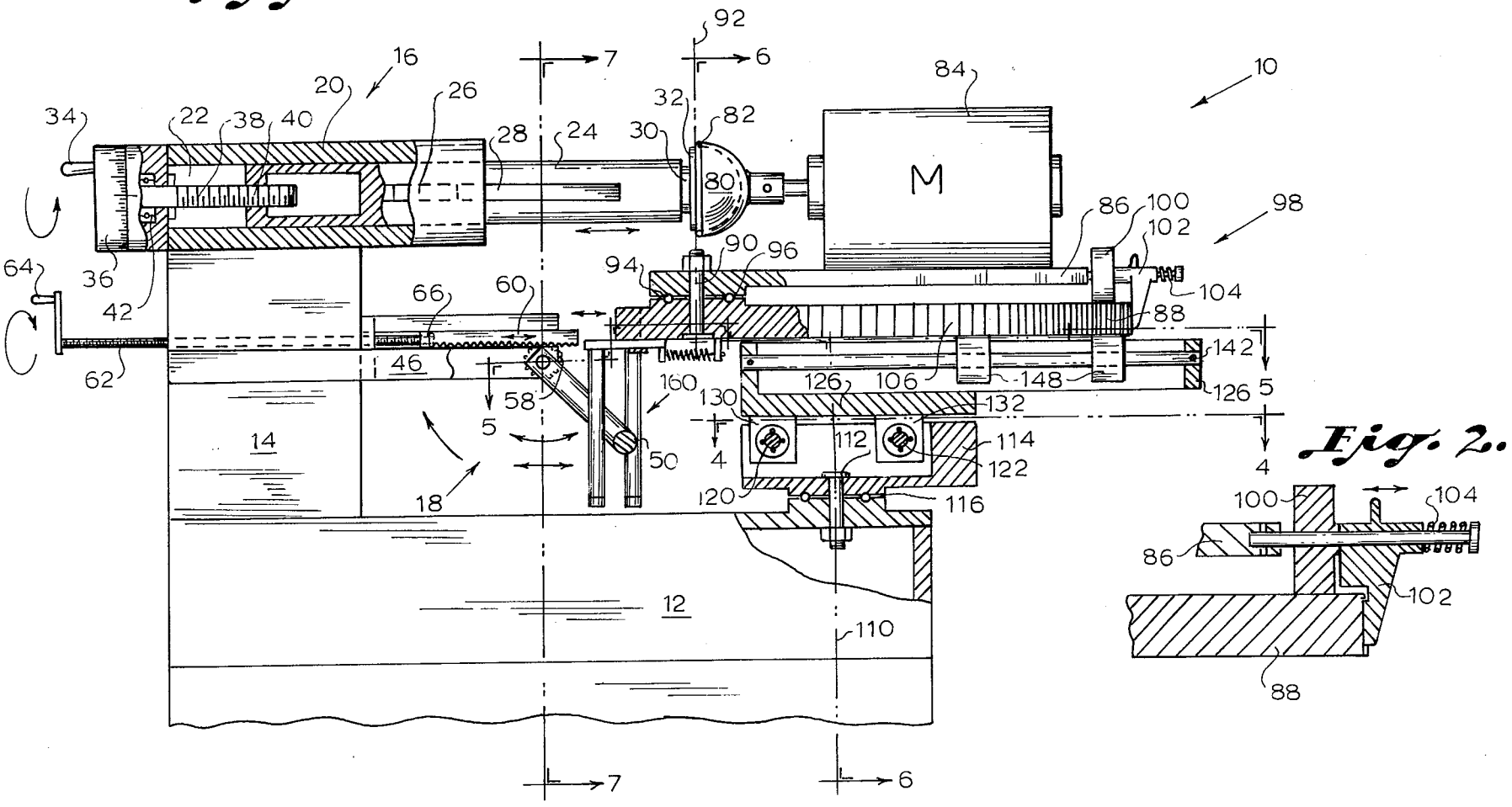
FIG. 1 shows a partially sectioned front elevation of a first preferred embodiment of the adjustable lens grinding apparatus.
FIG. 2 shows a frontal sectioned view of the cross curve deck locking device.

The adjustable lens grinding apparatus, generally referred to as 10 in FIG. 1, includes a support housing 12 to which is attached a tailstock riser 14 having a tailstock chuck assembly 16 and a cam assembly 18 attached thereto. The tailstock chuck assembly 16 is attached at the upper distended end of the tailstock riser 14 and includes a tailstock chuck housing 20 having a cylindrical bore 22 coaxially therethrough. A generally cylindrical chuck 24 slidably communicates within the cylindrical bore 22 and extends coaxially therefrom. A key 26 extends from the tailstock chuck housing 20 perpendicularly into a longitudinal slot 28 in the chuck 24 to prevent the rotation thereof. A removable lens holder 30 is attached at the distended end of chuck 24 and is adapted to receive and hold a standard ophthalmic lens blank 32. The lens blank 32 is generally disc shaped and has a central axis which is aligned with the central axis of the lens holder 30, which is in turn aligned with the central axis of the chuck 24. The chuck 24 is longitudinally extended from the tailstock chuck housing 20 by operation of a hand wheel 34 having a plurality of striations 36 around the circumferential surface thereof for indicating the thickness of the lens blank 32. The hand wheel 34 has a lead screw shaft 38 coaxially attached thereto for communicating with a nut coupling 40 attached at the other end of the chuck 24. A thrust bearing 42 allows the rotation of the hand wheel 34 and the threaded lead shaft 38 to be transformed into a linear motion of the chuck 24 as the lead screw shaft 38 rotatably couples with the nut coupling 40.

Figure 3:
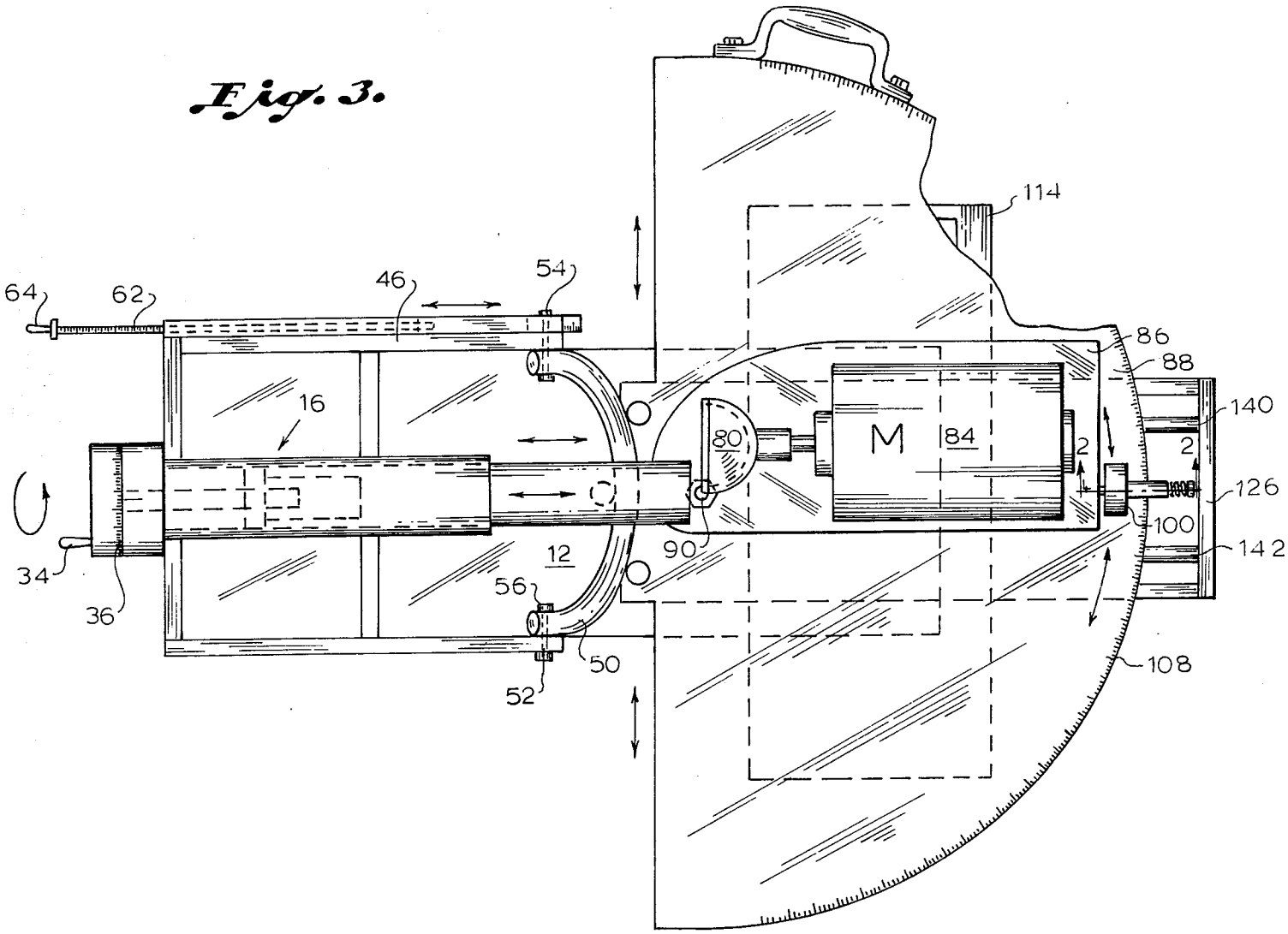
FIG. 3 shows a partially sectioned top view of the first preferred embodiment of the adjustable lens grinding apparatus.
Figure 4:
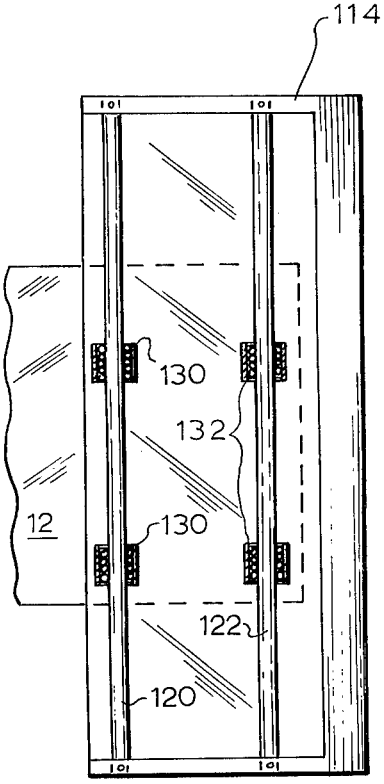
FIG. 4 is a top sectional view of the third and fourth support elements sectioned along line 4—4 as shown in FIG. 1.
Figure 8:
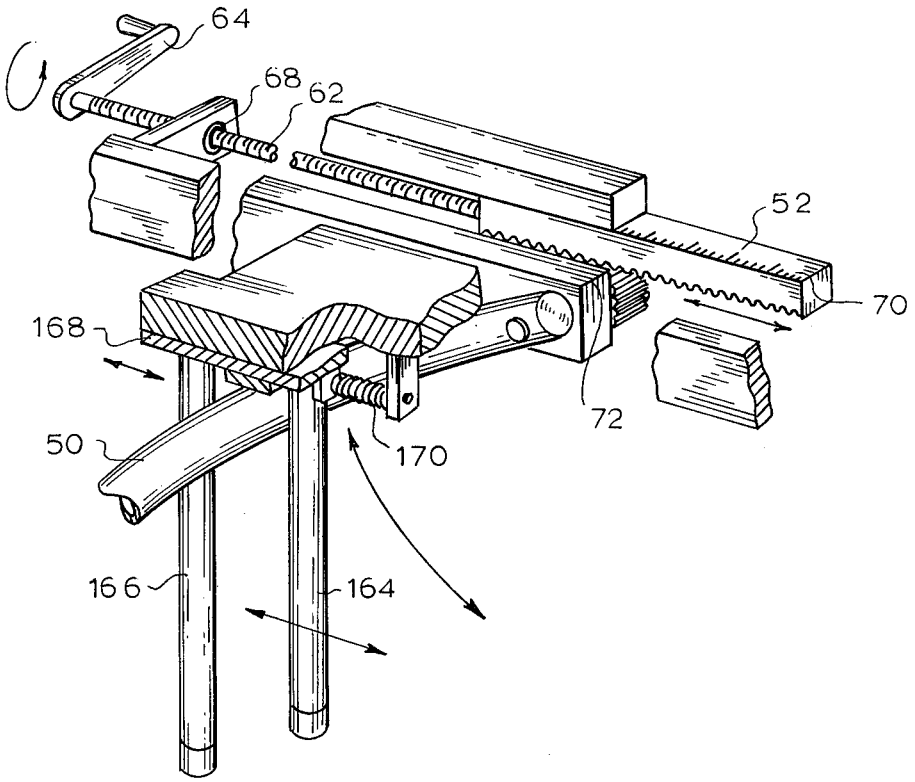
FIG. 8 is a sectional perspective view of the guide means.
Figure 9:
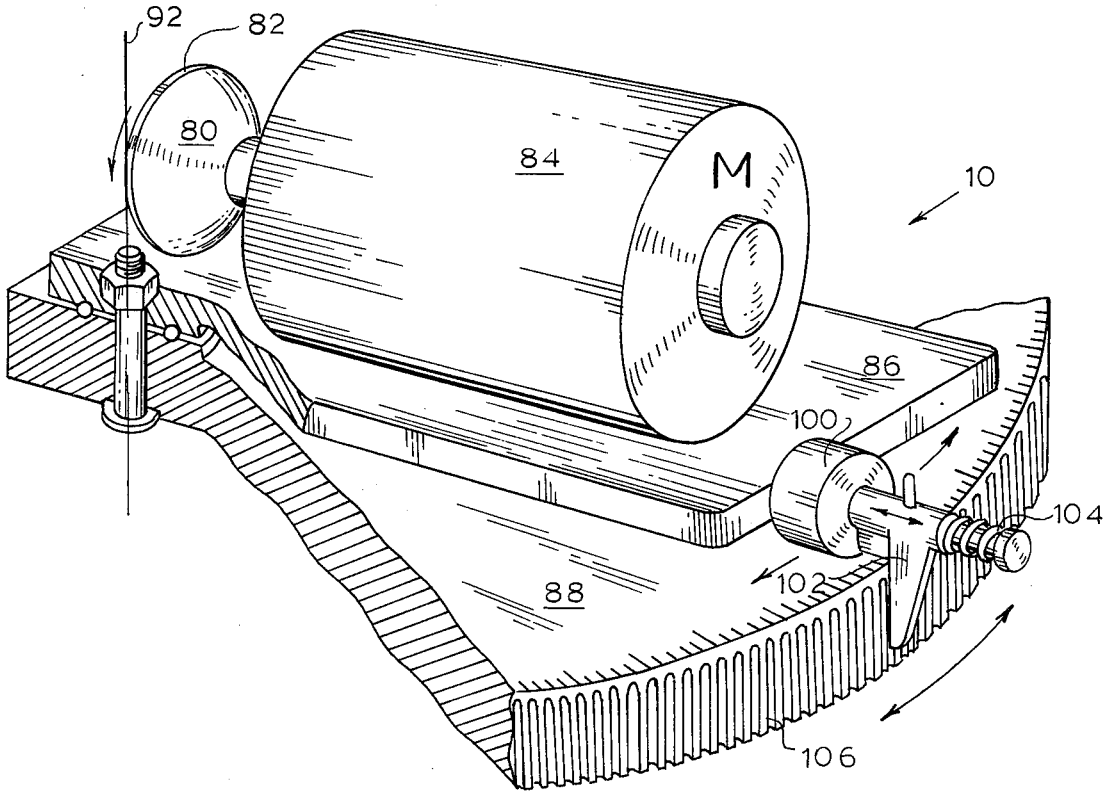
FIG. 9 is a perspective sectional view of the cross curve base deck and locking device.

With reference to FIGS. 1 and 3, the cam assembly 18 includes a bracket 46 extending perpendicularly from the tailstock riser 14 being generally parallel to the chuck 24. A generally arcuate cam 50 (or cambered guide), defining a cam plane containing the cambered surface and a cam axis perpendicular thereto, is rotatably attached to the distended ends of the bracket 46 about a rotational axis 52 defined by the bolts 54 and 56. The bolt 54 is firmly attached to one end of the arcuate cam 50 and communicates through the bracket 46 and terminates in a pinion gear 58. The pinion gear 58 couples with a movable rack gear 60 which is movably attached to bracket 46. A threaded shaft 62 having a hand wheel 64 attached at one end thereof communicates perpendicularly through the tail- stock riser 14 and rerminates in a nut coupling 66 attached at one end of the rack gear 60. As the hand wheel 64 is rotated, the rotation of the threaded shaft 62 within the nut coupling 66 causes the rack gear 60 to rotate the pinion gear 58, which in turn causes the arcuate cam 50 to rotate about its rotational axis 52. In this manner the arcuate cam 50 may be rotated approximately 180° about the rotational axis 52 (compare FIGS. 1 and 8). With reference to FIG. 8, the threaded shaft 62 has an acme thread for communicating with a balled nut retainer bearing 68 attached to the tailstock riser 14. A base curve diopter scale 70 is composed of a plurality of striations placed upon the top surface of the rack gear 60 opposite a reference striation 72 located generally at the distended end of the bracket 46 adjacent to the pinion gear 58.

With reference to FIGS. 1 and 3, the location of the arcuate cam 50 is illustrated as being subjacent to and generally aligned with the axis of the tailstock chuck assembly 16. This is a matter of geometric convenience since the position of the rotational axis 52 must be accurately located with respect to the plane of the lens blank 32. More specifically, the rotational axis 52 must be perpendicular to the central axis of the tailstock chuck assembly 16 and parallel to the plane of the lens blank 32 in order that the arcuate cam 50 may be accurately referenced to the planar surface of the lens blank 32 and the lens holder 30.

Figure 6:
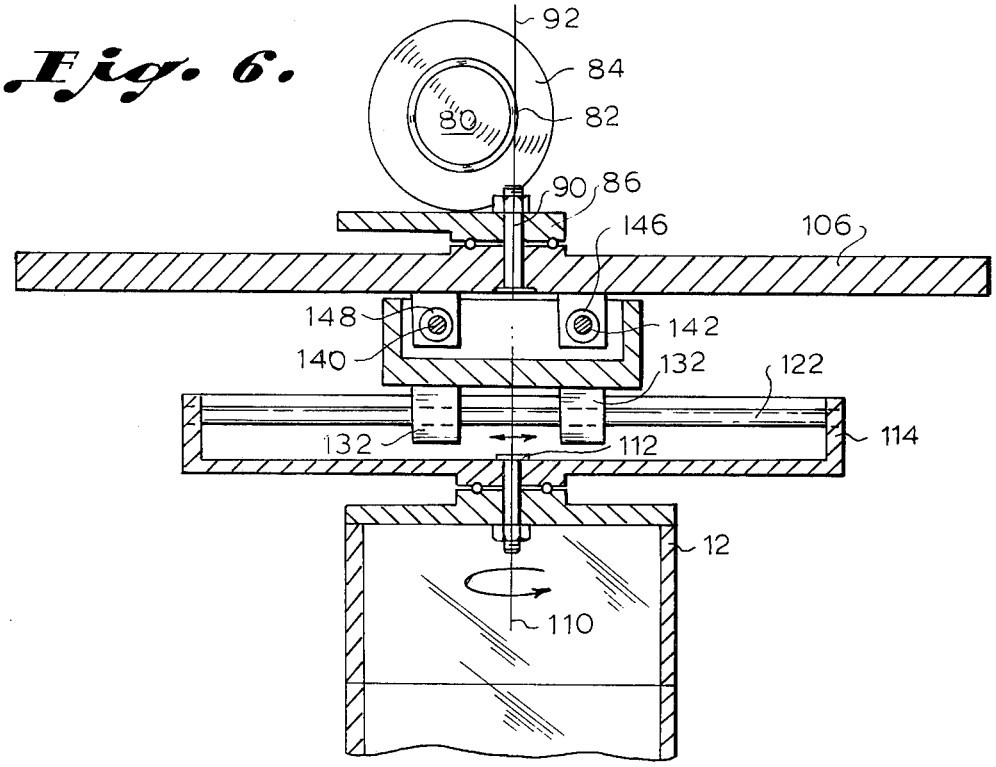
FIG. 6 is an end sectional view of the movable support elements and abrading cup taken along section line 6—6 as shown in FIG. 1.
Figure 7:
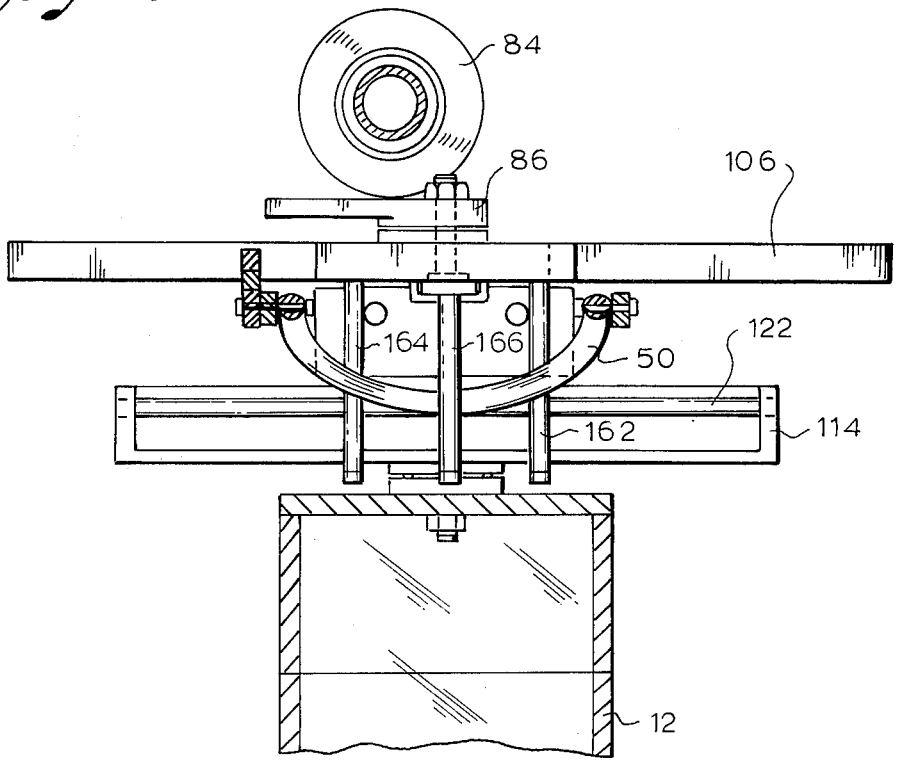
FIG. 7 is an end sectional view of the movable elements and guide means as taken along section line 7—7 as shown in FIG. 1.

With reference to FIGS. 1, 3 and 6, an abrading cup 80 having an abrasive edge 82 is attached to the central shaft of a wheel head motor 84, which in turn is attached to a cross curve deck 86. The cross curve deck 86 is rotatably attached to a cross curve base 88 by a second rotatable coupling shaft 90 which also defines a coaxially located abrading axis 92 therethrough. The cross curve deck 86 is generally parallel to but spaced above the cross curve base 88. A plurality of ball bearings 94 are located in a circular groove 96 centered about the abrading axis 92 and lying between the cross curve deck 86 and the cross curve base 88. The end of the cross curve deck 86 opposite the abrading axis 92 is secured to the shaped cross curve base 88 by a cross curve lock 98 comprising a roller 100 and a latch 102 biased by a spring 104 to engage one of a plurality of vertically disposed notches 106 arranged around the circumferential surface of the semicicular cross curve base 88. A plurality of diopter scale striations 108 are located adjacent to the circumferential surface of the cross curve base 88 for indicating the angular displacement of the plane of the abrasive edge 82 of the abrading cup 80 with respect to the plane of the lens holder 30 and the lens blank 32.

The rotational axis of the abrading cup 80 is parallel to and at the same vertical level with the central axis of the chuck 24 and the lens blank 32. With specific reference to FIG. 6, the abrading axis 92 is located coaxially with the second rotational coupling 90 and tangent to the circumferential abrading edge 82 of the abrading cup 80. Note that the rotational axis of the wheel head motor 84 and the abrading cup 80 are offset horizontally from the abrading axis 92.

The cross curve base 88 has two degrees of linear motion freedom which define a plane perpendicular to the abrading axis 92. The entire abrading assembly also has one degree of rotational freedom about a first pivot axis 110 which is parallel to but separated from the abrading axis 92. The first pivot axis 110 is defined by a first pivot bolt 112 which communicates between the support housing 12 and a third support element 114. As shown in FIGS. 1 and 6, the third support element 114 rotates about the first pivot axis 110 on a journal bearing 116, comprises a U-shaped channel member having two parallel linear guide beams 120 and 122 communicating within the channel and supported by the ends thereof. The two linear guide beams 120 and 122 define a plane which is perpendicular to the first pivot axis 110. A roller guide pair 130 is congruently coupled and slides along the linear guide beam 120 for moving linearly thereupon. Another roller guide pair 132 is similarly coupled to the linear guide beam 122. The roller guide pairs 130 and 132 are in turn coupled to the lower surface of a fourth support element 126. The fourth support element 126 comprises a generally U-shaped channel member having two linear guide beams 140 and 142 communicating within the channel and supported by the ends thereof. The linear guide beams 140 and 142 define a plane which is generally perpendicular to the first pivot axis 110. A pair of roller guides 148 congruently communicate with and slide along the linear guide beam 140. Similarly, another pair of roller guides 146 congruently communicate with and slide along the linear guide beam 142. The roller guide pairs 146 and 148 are attached to the underneath surface of the cross curve base 88. The perpendicular arrangement of the linear guide beams 120 and 122 with respect to the linear guide beams 140 and 142 allows the cross curve base 88 to move in two degrees of freedom which define a plane perpendicular to both the first pivot axis 110 and the abrading axis 92. Furthermore, the first pivot shaft 112 allows the cross curve base 88 to rotate about the first pivot axis 110. The need for this complex support apparatus will become apparent when the operation of the guide and guide following means are explained.

With reference to FIGS. 1, 3, 5 and 8, a cam follower assembly, generally shown as 160, includes a first follower shaft 162 and a second follower shaft 164 attached to a section of cross curve base 88 depending outwardly from the second rotational coupling 90. The first follower shaft 162 and the second follower shaft 164 are offset by equal distances from the center line of the cross curve base 88 which intersects the abrading axis 92 and bisects the distance between the roller guide pairs 148 and 146. The first and second follower shafts 162 and 164 are parallel to each other, both being perpendicular to the plane of the cross curve base 88 and parallel to but offset from the abrading axis 92. A biasing shaft 166 is located on the center line of the cross curve base 88 but is spaced longitudinally from both the abrading axis 92 and the first and second follower shafts 162 and 164. The biasing shaft 166 is parallel to both the first and second follower shafts 162 and 164. The biasing shaft 166 is perpendicularly attached to a movable plate 168 which slidably communicates along the lower surface of the cross curve base 88 and is biased toward the abrading axis 92 by a compression spring 170 attached to an arm depending from the cross curve base 88.

Figure 5:
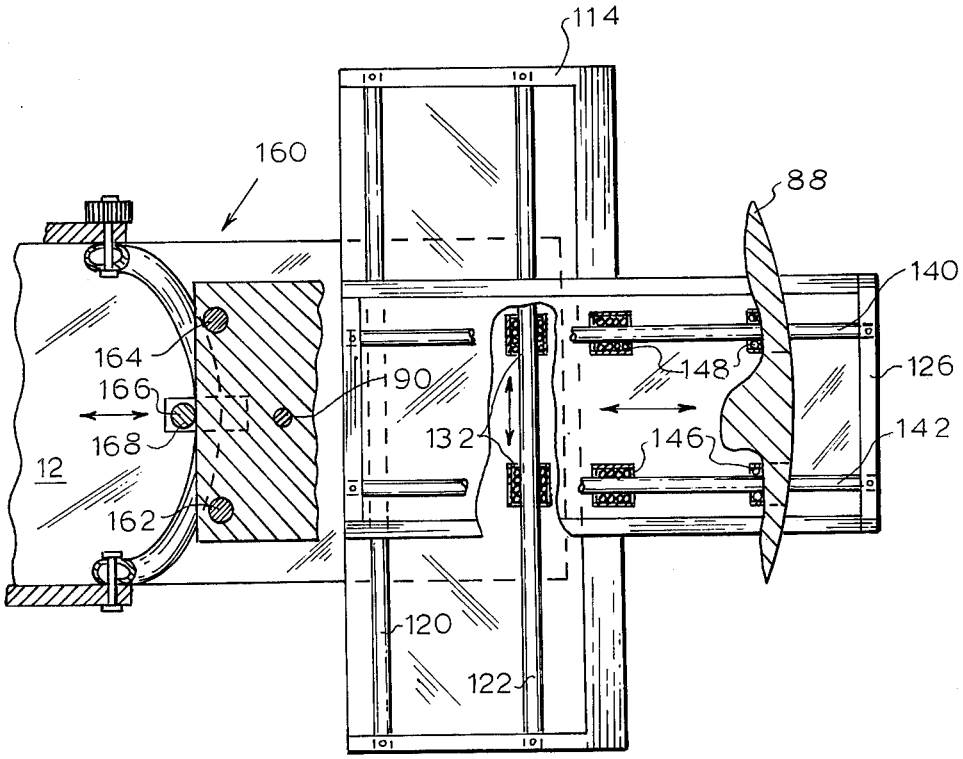
FIG. 5 is a top sectional view of the base and fourth support elements as viewed along section line 5—5 as shown in FIG. 5.

With particular reference to FIG. 5, the arcuate cam 50 is biased against the first and second follower shafts 162 and 164 by the biasing shaft 166. Since the distance between the rotational axis 52 of the arcuate cam 50 and the face of the lens holder 30 can be accurately determined by reading the striations on the thickness dial scale 36, and since the distance between the first and second follower shafts 162 and 164 and the abrading axis 92 of the abrading cup 80 are accurately known, the sweep of the abrading cup 80 through the lens blank 32 may be accurately determined by the first and second follower shafts 162 and 164 slidably communicating along the face of the arcuate cam 50. Since the first and second cam follower shafts 162 and 164 as well as the biasing shaft 166 depend perpendicularly from the cross curve base 88, the shafts may maintain communication with the arcuate cam 50 as it is rotated about its rotational axis 52.

With continuing reference to FIG. 5, the first and second follower shafts 162 and 164 in communication with the outside surface of the arcuate cam 50 will trace an arc of an imaginary circle having its center coincident upon a center line defined as the perpendicular bisector of the cam diameter as taken along the rotational axis 52 thereof. As the arcuate cam 50 is rotated outwardly about the rotational axis 52, the first and second follower shafts 162 and 164 will sweep in an arc of a circle having a small radius. As the arcuate cam 50 is rotated downwardly as shown in FIG. 1, the first and second follower shafts 162 and 164 will sweep across the arc of a circle having a much larger radius. Therefore, the rotation of the arcuate cam 50 about the rotational axis 52 thereof will allow the abrading cup 80 to sweep through the lens blank 32 with a plurality of possible convex arcs corresponding to a plurality of imaginary circles having their centers co-located upon the center line. When the arcuate cam 50 is depending perpendicularly downward from the bracket 46, the first and second follower shafts 162 and 164 will sweep a straight line. As the arcuate cam 50 is rotated further clockwise, as seen from the frontal elevation of FIG. 1, into a position presenting a concave arc to the first and second follower shafts 162 and 164, as shown in FIG. 8, the abrading cup 80 will sweep a concave arc corresponding to an imaginary circle having its center upon the center line 170. In this manner the radius of curvature swept by the abrading cup 80 during its abrading stroke through the lens blank 32 may be varied in adjustable increments from a small radius of convex curvature to a small radius of concave curvature.

The present state of the art prohibits generating lenses of extremely long radii or combining long radii of both concave and convex curvature on a lens surface which in the optical trade is called a "saddle-back" curve. Prior to this disclosure, this type of lens had to be ground by hand and is most time consuming. With the ability to change the angle of the work head motor (84) to any degree to abrade in a concave or convex manner, it is possible to create any type of cross curve or vertical curve without regard to the angle of the cam 50 (regardless of convex, concave or infinity).

The arcuate cam 50, as shown in FIGS. 1 and 3, has a semicircular shape and is formed from a length of circular tubing or stock. The axis of rotation 52 of the semicircular cam 50 is a chord of the circle, perpendicular to the radius from the linear center of the cambered surface of the cam. As shown in FIG. 3, the axis of rotation 52 is a diameter of the semicircular cam 50. With this arrangement a plurality of curves may be formed on the lens blank, the curves having a range of radii from the radius of the semicircular cam 50 (either concave or convex) through infinity (approached from the concave or convex direction). Of course, the physical limits of the head stock and the diameter of the abrading wheel must also be considered.

The operation of the adjustable lens grinding apparatus 10 will now be described with references to FIGS. 1 and 3. The lens blank 32 is secured to the lens holder 30 in a manner well known in the art, and then the lens holder 30 is secured to the chuck assembly 24. Next the cross curve deck 86 is rotated into the proper position as indicated by the diopter scale striations 108 along a circumferential surface of the cross curve base 88. The latch 102 of the cross curve lock assembly 98 is then engaged with the corresponding notch 106 in the cross curve base assembly. The hand wheel 64 is then rotated to adjust the rotational position of the arcuate cam 50 to the proper position as indicated by the reference striation 72 relative to the base curve diopter scale 70. Next, the hand wheel 34 is used to adjust the thickness dial scale 36 to a zero position corresponding to the abrading axis 92 of the abrading cup 80 being in close communication with the rear surface of the lens holder 30. The thickness dial scale 36 is then rotated by the use of the hand wheel 34 to obtain the proper lens thickness. This adjustment causes the lens chuck 24 to retract into the trail stock chuck housing 20 by a distance corresponding to the mean lens thickness desired. Assuming that the wheel head motor 84 is already rotating the abrading cup 80, the operator then places the abrasive edge 82 of the abrading cup 80 adjacent to the lens blank 32 and proceeds to sweep the abraiding cup 80 through the plane of the lens blank 32 as determined by the arc swept by the first and second follower shafts 162 and 164 in communication with the arcuate cam 50. At this point it will be obvious that the complex structure required to provide the two degrees of linear motion freedom and one degree of rotation motion freedom of the cross curve base 88 are required to allow the first and second cam following shafts 162 and 164 to accurately follow the arcuate cam 50.

Figure 10:
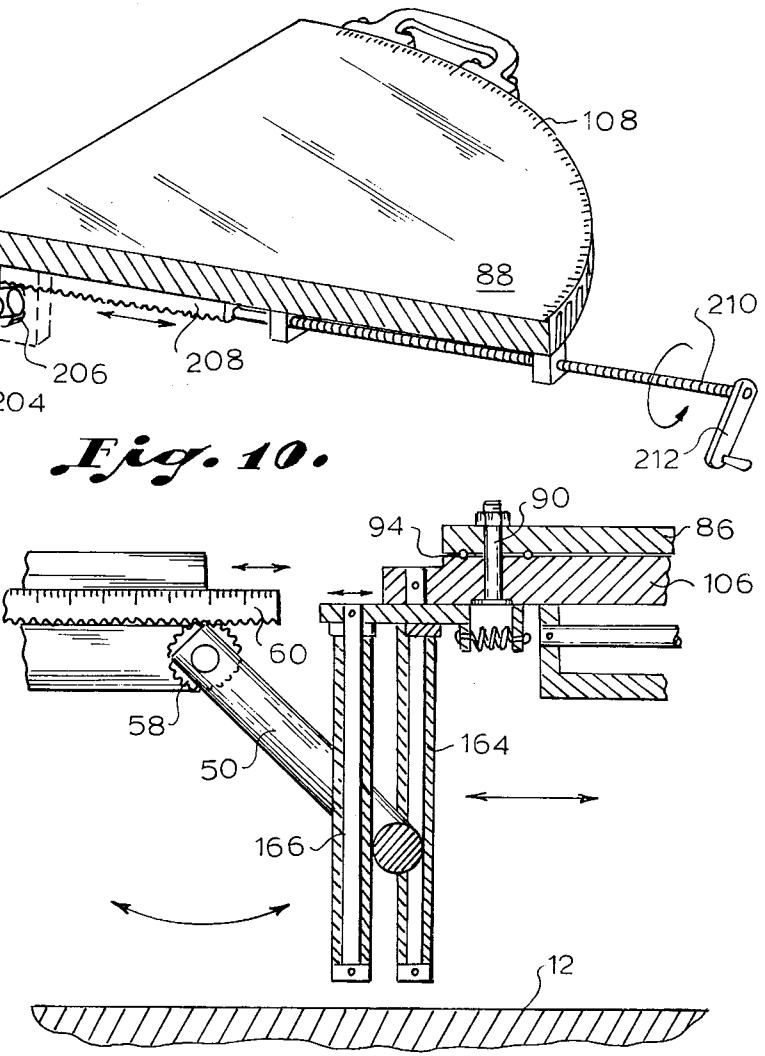
FIG. 10 is a frontal cross-section view of the guide means of the first preferred embodiment of the adjustable lens grinding apparatus.
Figure 11:
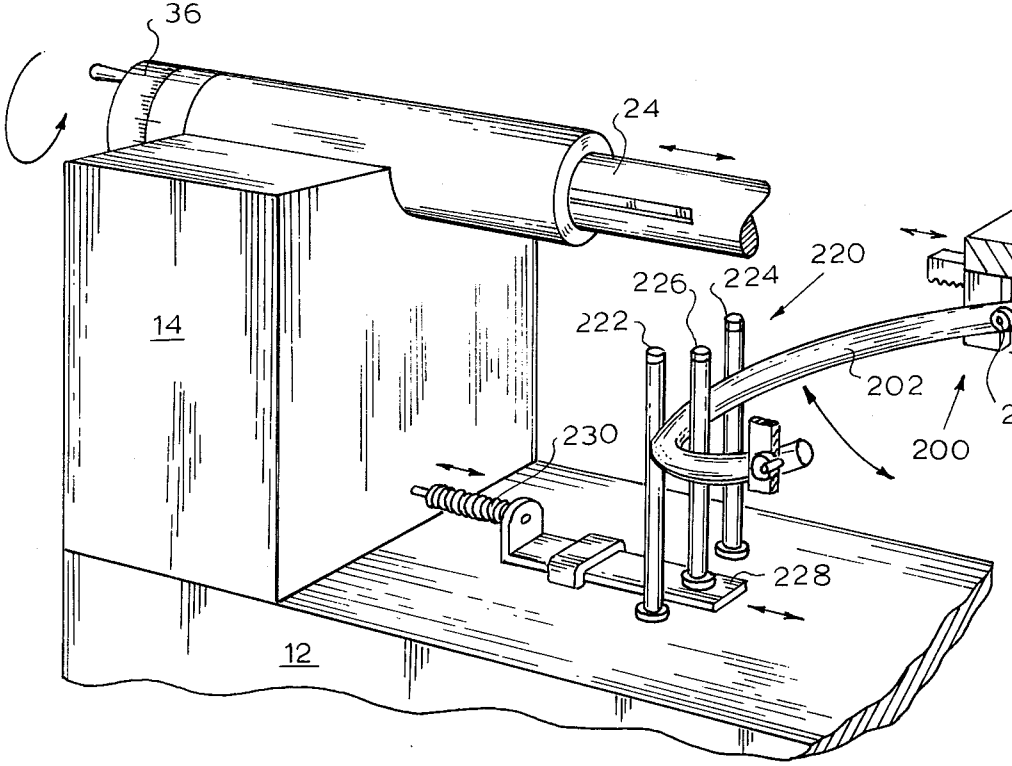
FIG. 11 is a sectional perspective view of a second preferred embodiment for the guide means used with the adjustable lens grinding apparatus.

With specific reference to FIG. 11, the second preferred embodiment of the arcuate cam assembly 200 and a cam follower assembly 220 are illustrated. As arcuate cam 202 is rotatably attached about a pivot 204 to a pinion gear 206 in communication with a rack gear 208. The rack gear 208 moves longitudinally beneath the cross curve base 88 responsive to the rotation of the threaded shaft 210 and the handle 212 coupled thereto. The cam following assembly 220 includes a first follower shaft 222 and a second follower shaft 224 upwardly extending perpendicular to the plane of the cross curve base 88. An upwardly extending biasing shaft 226 biases the arcuate cam 202 into communication with the first and second follower shafts 222 and 224 by operation of the restraining force provided by the compression spring 230 communicating between the support housing 12 and the movable bracket 228. It will of course be obvious that as long as the relative positions between the lens blank (attached to the tailstock chuck assembly), the cam following assembly, the arcuate cam, and the abrading axis of the abrading cup are accurately known, it is only a matter of design convenience as to whether the arcuate cam is attached to the cross curve base 88 (as shown in FIG. 11) or the bracket 46 attached to the support housing 12 (as shown in FIGS. 1 and 10).

It will be clear at this point that an adjustable lens grinding apparatus has been provided which overcomes some of the problems of the prior lens generators. However, the invention is not to be construed as limited to the particular forms disclosed herein since these embodiments are to be regarded as illustrative rather than restrictive.

I claim:

1. A lens grinding apparatus of a type having a chuck for securing a planar lens blank thereto, an abrading device for sweeping through a lens blank secured to said chuck during an abrading stroke, and means for guiding said abrading device during said abrading stroke, wherein an improvement in the apparatus for movably supporting said chuck with respect to said abrading device comprises:

a first member for supporting said chuck;

a second member for supporting said abrading device, said abrading device being spaced longitudinally from said chuck; and positioning means operably coupled between said first and second members for regulating the relative motion therebetween to free movement in two degrees of linear freedom and one degree of rotational freedom as said abrading device sweeps through said lens blank attached to said chuck, said tao degrees of linear freedom defining a base plane perpendicular to said plane of said lens blank, and with said one degree of rotational freedom defining a first axis parallel to said plane of said lens blank and perpendicular to said base plane, whereby said positioning means is freely and continuously movable in said base plane while guided during the abrading stroke by said guiding means; said positioning means having a first coupling rotatably attached to said first member about said axis and a second coupling rotatably attached to said second member, said second coupling defining a second axis parallel to said first axis and tangent to said abrading device; and first planar means coupled between said first and second couplings for limiting the relative motion therebetween to a plane parallel to said base plane.

2. The apparatus recited in claim 1 wherein said first axis is spaced from said second axis.

3. The apparatus recited in claim 1 wherein said first planar means comprises:

a first frame element movably attached to said first coupling;

a second frame element movably attached to said second coupling;

second planar means for movably coupling said first and second frame elements, said movement therebetween being defined by a plane parallel to said base plane.

4. The apparatus recited in claim 3 wherein said second planar means comprises:

first linear guide means attached to said first frame element generally parallel to said base plane;

second linear guide means coupled to said second frame element generally parallel to said base plane, with said second linear guide means being generally perpendicular to said first linear guide means and said first axis;

linear coupling means for movably coupling between said first and second linear guide means, said relative motion between said first linear guide means and second linear guide means defining a plane parallel to said base plane.

5. The apparatus recited in claim 3 including means for adjustably restricting the relative rotation of said second member and said second frame element about said second coupling.

6. A lens grinding apparatus of a type having a chuck for securing a lens blank thereto and an abrading cup having an annular abrading surface thereon for sweeping through said lens blank during said abrading stroke, wherein an improvement in the apparatus for guiding said abrading cup during said abrading stroke comprises:

a first member for supporting said chuck and said lens blank secured thereto, said lens blank defining a plane generally perpendicular to an axis of said chuck;

a second member for movably supporting said abrading cup, said abrading cup having an axis of rotation centered therethrough and an annular abrading surface at the distended circumference thereof, with said abrading cup being spaced longitudinally from said chuck;

a guide having a cambered surface thereon and guide following means movably coupled to said guide for following along said guide during relative motion therebetween, said guide and said guide following means being operably interposed between said first member and said second member for guiding the sweep of said abrading cup through said lens blank during said abrading stroke; and first means for changing the effective camber of said cambered surface of said guide, whereby said sweep of said abrading cup through said lens blank may be altered to provide a plurality of different lens surfaces.

7. An improved guiding apparatus as described in claim 6 including independent adjusting means interposed between said first member and said second member for moving said chuck longitudinally with respect to said abrading cup.

8. The apparatus recited in claim 7 wherein said first means includes means for rotating said guide relative to said guide following means for changing the effective camber thereof, thereby causing said abrading cup to sweep through said lens blank with a different abrading stroke producing a different lens surface.

9. The apparatus recited in claim 8 wherein said rotation of said guide exposes a different section of said guide to be followed by said guide following means, thereby causing said abrading cup to sweep through said lens blank with a different abrading stroke producing a different lens surface.

10. The apparatus recited in claim 9 wherein said camber of said guide further includes means for generating both concave and convex abrading strokes as said abrading cup sweeps through said lens blank.

11. The apparatus recited in claim 7 wherein said guide comprises a cam and said guide following means comprises a cam follower for communicating with said cam, said cam being defined by a cam plane and a cam axis perpendicular thereto, said cam plane including said cambered surface therein.

12. The apparatus recited in claim 11 wherein said cam is rotatably secured to said second member at a known distance from said annular abrading surface of said abrading cup, and wherein said cam follower is secured to said first member at a known distance from said chuck, whereby said abrading cup sweeps through said lens blank responsive to said cam follower following said cam.

13. The apparatus recited in claim 11 wherein said cam is rotatably secured to said first member at a known distance from said chuck and wherein said cam follower is secured to said second member at a known distance from said annular abrading surface of said abrading cup, whereby said abrading cup sweeps through said lens blank responsive to said cam follower following said cam.

14. The apparatus recited in claim 13 wherein said means for rotating said cam includes angular means for rotating said cam about an axis of rotation perpendicular to said cam axis.

15. The apparatus recited in claim 14 wherein said axis of rotation is included within said cam plane.

16. The apparatus recited in claim 15 wherein said angular means includes means for varying the included angle between said cam and said cam follower, thereby exposing a different section of said cam to be followed by said cam follower.

17. The apparatus recited in claim 14 wherein said cam comprises an arcuate rod, said rod having a circular cross-section.

18. The apparatus recited in claim 17 wherein said arcuate rod includes the arc of a circle.

19. The apparatus recited in claim 17 wherein said axis of rotation comprises a chord of said arcuate rod, said chord being parallel to said plane of said lens blank.

20. The apparatus recited in claim 11 further including means for biasing said cam follower into said cam, thereby achieving close communication therebetween.

21. The apparatus recited in claim 11 wherein said cam follower comprises a first element for communicating with said cambered surface of said cam, said first element having a first axis parallel to said plane of said lens blank.

22. The apparatus recited in claim 21 wherein said cam follower further includes a second element for communicating with said cambered surface of said cam, said second element having a second axis parallel to but spaced from said first axis.

23. A lens grinding apparatus of a type having a chuck for securing a planar lens blank thereto and an abrading cup for sweeping through said lens blank during an abrading stroke, wherein an improvement in the apparatus for positioning said chuck with respect to said abrading cup and guiding said abrading cup during said abrading stroke comprises:

a first member for supporting said chuck;

a second member for supporting said abrading cup, said abrading cup having an axis of rotation centered therethrough and an annular abrading surface at the distended circumference thereof, said abrading cup being longitudinally spaced from said chuck;

positioning means operably coupled between said first member and said second member for enabling continuous relative motion therebetween in two degrees of linear freedom defining a base plane perpendicular to said plane of said lens blank, with said one degree of rotational freedom defining a first rotational axis parallel to said plane of said lens blank and perpendicular to said base plane;

a guide having a cambered surface thereon;

guide following means for following said cambered surface of said guide, said guide and said guide following means being operably interposed between said first member and said second member for guiding said sweep of said abrading cup through said lens blank during said abrading stroke responsive to the effective camber of said guide; and first means for altering said effective camber of said guide, whereby said sweep of said abrading cup through said lens blank may be altered to provide a plurality of different lens surfaces.

24. The apparatus as recited in claim 6 wherein:

said guide comprises an arcuate rod defining said cambered surface thereon, said arcuate rod being movably coupled about a rotational axis thereof to said first member; and wherein said guide following means comprises first and second elements juxtaposed on opposing sides of said arcuate rod for movably communicating along said cambered surface thereof, with said first and second elements being operably coupled to said second member for guiding said abrading cup through said lens blank responsive to the effective camber of said arcuate rod being swept by said guide following means.

25. The apparatus as recited in claim 24 wherein said first means comprises:

pinion gear means operably coupled to said arcuate rod about said rotational axis thereof, with said rotational axis defining a cord of said arcuate rod; and rack gear means movably engaging said pinion gear means for rotating said arcuate rod about said rotational axis thereof for changing the effective camber of said cambered surface.

26. A lens grinding apparatus of a type having a chuck for securing a planar lens blank thereto, an abrading cup having an abrading circumference spinning about a rotational axis for sweeping through said lens blank during an abrading stroke, and guiding means for guiding said abrading cup during said abrading stroke, wherein the improvement in the apparatus for movably supporting said chuck with respect to said abrading cup comprises in combination:

a first support for said chuck;

a second support for said abrading cup, said abrading cup being spaced longitudinally from said chuck;

third support means rotatably coupled to said first support about a first pivot having a rotational axis generally perpendicular to said rotational axis of said abrading cup; and fourth support means movably coupled between said third support means and said second support means for allowing free relative movement therebetween in a base plane generally perpendicular to said first pivot axis, whereby said abrading cup is freely movable in said base plane and about said first pivot axis for being guided during the abrading stroke by said guide means; and said second support comprising a base movably coupled to said fourth support, a deck for supporting said abrading cup, a second pivot for rotatably coupling said base to said deck, said second pivot being parallel to but spaced from said first pivot, said second pivot shaft defining an axis tangent to said abrading circumference of said abrading cup, whereby the angular position of said deck with respect to said base may be varied to provide an angular offset between said abrading cup and said lens blank.

27. The apparatus as recited in claim 26 wherein:

said third support means includes a first plurality of parallel beams defining a plane perpendicular to said first pivot axis; and wherein said fourth support means includes a plurality of bearing means for moving along said plurality of first parallel beams.

28. The apparatus as recited in claim 27 wherein said fourth support means further includes a second plurality of parallel beams defining another plane generally perpendicular to said first pivot axis; and wherein said second support further includes a plurality of bearing means for moving along said second plurality of parallel beams, whereby said second support is freely movable in said base plane as said abrading cup is guided by said guide means through said abrading stroke.

29. The apparatus recited in claim 28 wherein said beams comprise cylindrical shafts and said bearing means comprise antifriction ball bearings.

30. The apparatus recited in claim 26 including locking means for maintaining the angular position of said deck with respect to said base.

* * * * *